US006394686B1

(12) United States Patent
Whaley et al.

(10) Patent No.: US 6,394,686 B1
(45) Date of Patent: May 28, 2002

(54) CLINCH FASTENER

(75) Inventors: Paul Whaley, Herculaneum; Jerry Ostrander, St. Louis, both of MO (US)

(73) Assignee: U.S. Ring Binder LP, St. Louis, MO (US)

( * ) Notice: Subject to any disclaimer, the term of this patent is extended or adjusted under 35 U.S.C. 154(b) by 0 days.

(21) Appl. No.: 09/759,771

(22) Filed: Jan. 13, 2001

(51) Int. Cl.[7] ..... B42F 13/00

(52) U.S. Cl. ..... 402/26; 402/36; 402/31; 402/80 R; 402/75

(58) Field of Search ..... 402/36, 27, 26, 402/75; 24/703.5, 703.6

(56) References Cited

U.S. PATENT DOCUMENTS

| | | | | |
|---|---|---|---|---|
| 5,100,253 A | | 3/1992 | Cooper | |
| 5,160,209 A | | 11/1992 | Schuessler | |
| 5,378,073 A | | 1/1995 | Law | |
| 5,577,852 A | | 11/1996 | To | |
| D377,805 S | | 2/1997 | To | |
| 5,755,513 A | | 5/1998 | To | |
| 5,772,348 A | | 6/1998 | To | |
| 5,842,807 A | | 12/1998 | To | |
| 5,879,097 A | | 3/1999 | Cheng | |
| 5,903,958 A | * | 5/1999 | Whaley | 402/75 X |
| 5,924,811 A | | 7/1999 | To et al. | |
| D414,802 S | | 10/1999 | Whaley | |
| D414,803 S | | 10/1999 | Whaley | |
| D414,804 S | | 10/1999 | Whaley | |
| 5,971,649 A | | 10/1999 | To | |
| 5,980,146 A | | 11/1999 | To | |
| 6,007,265 A | | 12/1999 | Whaley | |
| 6,007,266 A | | 12/1999 | Cheng et al. | |
| 6,019,538 A | | 2/2000 | Whaley | |

* cited by examiner

*Primary Examiner*—Willmon Fridie, Jr.
(74) *Attorney, Agent, or Firm*—Polster, Lieder, Woodruff & Lucchesi, L.C.

(57) ABSTRACT

A concealed, clinch ("crown") fastener (30) includes a cylindrical body (32) closed at one end to form a surface (34) deformable to attach the fastener to a binder ring mechanism (18). A first set (40) of prongs (42) extend from the opposite, open end of the fastener body to attach the fastener to a binder spine material (M) when the prongs are driven into the material. A second set (50) of prongs (52) are also formed at this end of the fastener, intermediate adjacent prongs comprising the first set. These prongs are shorter in length than those comprising the first set, and while the prongs forming the first set extend from the body in one direction, the prongs forming the second set extend in the opposite direction. The fastener provides better holding strength than other concealed fasteners and better resists pulling and twisting forces which tend to pull the mechanism away from the binder cover than these other fasteners.

20 Claims, 4 Drawing Sheets

CLINCH FASTENER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to ring binders, and more particularly, to improvements in a "crown" or clinch fastener for securing the shield of a binder ring mechanism to a spine portion of a binder. The fastener is a concealed fastener which securely attaches the mechanism to the binder spine, but does not penetrate through a cover of the binder so the fastener's presence is not visible and the ring binder has a desired cosmetic appearance. Use of the crown fastener further simplifies the manufacturing process used to make a binder by eliminating operations previously required with other concealed fasteners.

Over the last few years there have been a number of developments in concealed fasteners for use in attaching a binder ring mechanism to the cover portion of a binder. The attractiveness of the fasteners recently developed is that while they secure the mechanism to the binder, the fastener is not readily visible. In particular, unlike rivets previously used for attachment purposes, there is nothing showing on the outside of the binder. This results in a cleaner, more attractive appearance.

Up until the development of the clinch fastener disclosed in co-assigned U.S. Pat. No. 6,019,538 (the '538 patent), concealed fastener development, including that done by the assignee of this application and the '538 patent, has involved a fastener construction employing a base plate (typically rectangular, but also round) from which is struck a plurality of prongs. The prongs all extend from the same side of the base plate and are used to attach the fastener to a of compressed cardboard or similar backing which forms the binder spine. Extending from the opposite side of the base plate has been a post the outer end of which projects through an opening in the shield of the binder ring mechanism. The post not only acts as a spacer to space the binder ring mechanism from the binder spine, but the post is also secured to the shield, so to attach the fastener to the mechanism. In some prior art constructions the post is formed with base plate. In other constructions, for example, the Schuessler U.S. Pat. No. 5,160,209, the post is a separate piece. In some concealed fastener constructions, the fastener is used with a spacer or eyelet which fits over the post and facilitates attachment of the fastener to the mechanism. In addition to the U.S. Pat. No. 5,160,209 mentioned above, the following United States Patents show and describe various concealed fastener constructions or improvements to these constructions; Cooper et al. U.S. Pat. No. 5,035,526, Cooper U.S. Pat. No. 5,100,253, To U.S. Pat. Nos. 5,755,513, 5,772,348 and U.S. Pat. No. 5,842,807, Cheng U.S. Pat. No. 5,879,097, Whaley U.S. Pat. No. 5,903,958, To U.S. Pat. Nos. 5,924,811, 5,971,649, and 5,980,146, To et al. U.S. Pat. No. 5,924,811, Whaley U.S. Pat. No. 6,007,265, Cheng et al. U.S. Pat. No. 6,007,266, and Whaley design U.S. Pat. Nos. 414,802, 414,803, and 414,804.

With the exception of the '538 patent, when fabricating a binder using the above-noted prior art concealed fastener constructions, a pair of concealed fasteners are first attached to respective ends of the shield. This is accomplished by inserting the outer end of the posts through openings formed in each end of the shield from the underside of the shield. The outer ends of the posts are then upset about the outer surface of the shield adjacent the respective openings. In some constructions, such as shown in the Schuessler '209 patent, a separate sleeve or eyelet must be installed on the post so as to hold the shield in its desired relationship with the binder when the outer end of the post is upset. In other applications, as shown in To '807 patent, the post has a narrower outer end which is inserted through the opening in the shield such that when the outer end of the post is upset, the shield is rigidly secured to the post between shoulder on the post and the upset head. In any event after prior art fasteners are secured, the prongs formed in, and extending from the fastener plate are pressed into the spine material. The force used to press them into the cardboard backing causes the prongs to splay outwardly so a thickness of cardboard is compressed between the fastener plate and the prongs.

The clinch fastener described in the '538 patent departs from the previous designs in that this fastener has no base plate nor a post drawn from the base plate for attaching the fastener to the shield of the mechanism. Rather, this clinch fastener comprises a cylinder closed at one end and with prongs formed at the opposite, open end of the cylinder. The outer surface of the closed end of the cylinder is abutted against the underside of the shield and the clinch fastener is attached to the shield by striking the outer surface of the shield with a tool thus to interlock the end of the cylinder and the shield in a clinched relation. This action forces a portion of the shield into the surface formed by the closed end of the cylinder and at the same time deforms a portion of this surface about the shield. As with the prior art fasteners, two clinch fasteners are used, with a fastener being attached to each end of the shield. After the sub-assembly is formed, the prongs formed on the opposite end of the clinch fastener are pressed into the backing material to attach the sub-assembly to the binder spine.

Besides the clinch fastener described in the '538 patent being a concealed fastener, the fastener has other advantages over the prior art fasteners. Testing has found that the clinch fastener has better holding strength than conventional concealed fasteners, particularly when subjected to side loads. This is important because if a fastener is unable to keep the binder ring mechanism from being torn away from the binder spine when the binder is in use, then the appearance aspect provided by the fastener is superfluous. The addition of spurs to the ends of the prongs on the clinch fastener, such as taught in co-assigned Whaley U.S. Pat. No. 5,903,958, helps increase the holding power of the fastener. Further in this regard, as described above, when the prongs of conventional concealed fasteners are driven into the cardboard backing board material of the binder spine, the cardboard is sandwiched between the fastener plate and the prongs. This compresses and fractures the cardboard, weakening it and making it easier to pull the fastener away from the binder spine.

In addition to improved holding strength, the clinch fastener simplifies manufacturing operations. This is because certain conventional concealed fasteners (such as shown in the '709 and '807 patents, but not the '538 patent) require holes to be drilled into the shield so the fasteners'posts can be inserted through them. The clinch fastener does not require any such openings, thus saving a manufacturing step.

While the clinch fastener described in the '538 patent has these various advantages, further improvements can be made. For example, in binder testing, it has been found that repeated side loads on the shield assembly (as when a user turns a large number of pages inserted in the binder) can cause the assembly to pull away from the binder spine even when relatively low levels of force are applied. The crown fastener of the present invention solves this problem in addition to providing increased holding capability over the clinch fastener described in the '538 patent.

BRIEF SUMMARY OF THE INVENTION

Among the several objects of the present invention may be noted the provision of a "crown" or clinch fastener for attaching the ring mechanism of a binder to a spine portion of the binder. The clinch fastener is a concealed fastener that does not penetrate through to the outside of a binder cover when the fastener is attached to the binder spine. The fastener thus is not visible when in place and creates a desired cosmetic appearance for the binder.

A further object of the invention is an improved clinch fastener having two sets of prongs or teeth for attaching the fastener to the spine backing material. The first set of prongs splay outwardly relative to the longitudinal centerline of the fastener when the fastener is attached to the backing material and spurs are formed on the ends of the prongs to better grip the material. The second set of prongs are shorter in length than the first set, and alternate with the prongs comprising the first set. Each of the prongs of the second set are inwardly turned. These prongs also grip the spine backing material. Having two sets of prongs splayed in opposite directions improves the holding capability of the fastener, and prevents twisting of the binder ring mechanism relative to the binder when the binder is subjected to side loads. These features make the binder more durable and capable of withstanding a great amount of force without the shield portion of the assembly separating from the binder cover.

Another object of the invention is an improved clinch fastener in which the length of the prongs forming the second set generally correspond to the thickness of the backing material whereas the length of the prongs forming the first set is greater than the backing thickness. During attachment of the crown fastener to the backing material, the prongs forming the second set penetrate the backing material at a shallow angle whereas the prongs forming the first set splay outwardly at a somewhat greater angle. Regardless, neither set of prongs penetrate through the backing material so none of the prongs of either set are visible on the outside of the binder.

Yet another object of the invention is an improved clinch fastener in which a pair of fasteners are used, one at each end of the binder ring mechanism, to secure the mechanism to the binder. Importantly, because no portion of either fastener has to extend through the shield of the mechanism in order for the fasteners to be attached to the shield, the manufacturing process requires fewer steps. Since the fastener is attached to the underside of the cover and does not extend through any opening in the shield, the fastener is not visible when the binder is open either. Also, the fasteners can readily be used with automated equipment for the volume manufacture of ring binders.

Finally, it is an object of the invention to provide an improved clinch fastener which is a low cost fastener but provides a very strong means for attaching the binder ring mechanism to the binder and to do so while providing a desired cosmetic appearance.

In accordance with the invention, generally stated, a concealed clinch fastener, which is also referred to as a "crown" fastener, includes a cylindrical body closed at one end. This closed end of the fastener forms a surface deformable to attach the fastener to the shield of a binder ring mechanism by abutting the surface against the underside of the shield and striking the shield with a tool to deform a portion of the shield and surface about each other. A first set of prongs are formed at an opposite, open end of the fastener body and project outwardly therefrom to attach the fastener to the binder when the prongs are driven into the backing to secure the fastener to the backing. A second set of prongs are also formed at the open end of the cylinder, but these prongs extend inwardly rather than outwardly. The prongs comprising the second set are shorter in length than those comprising the first set and are also driven into the backing material. The prongs forming the second set both increase the holding strength of the clinch fastener and prevent twisting of the binder ring mechanism once attached to the binder. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 3:
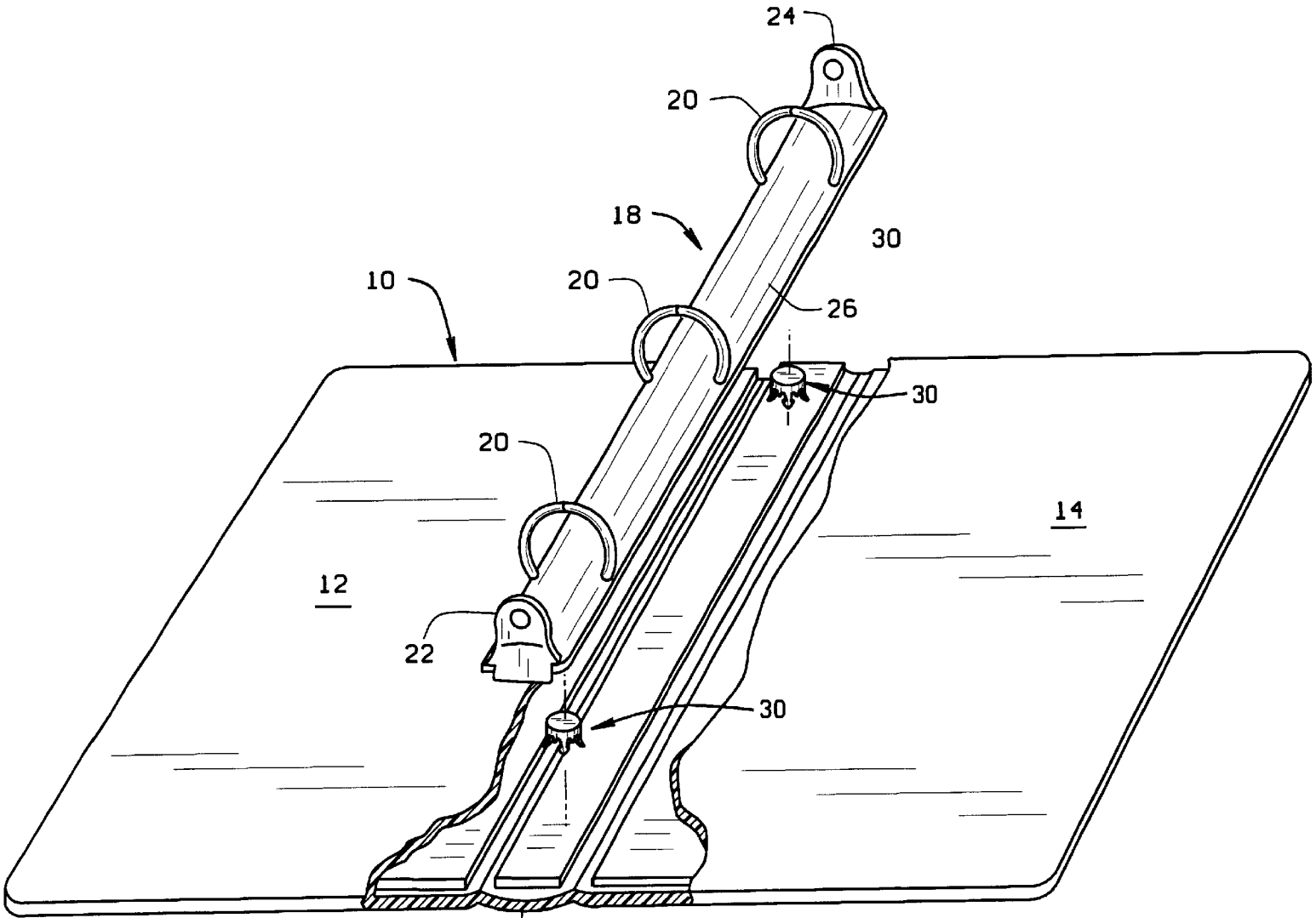
FIG. 3 is an exploded view illustrating use of a pair of clinch fasteners to secure a binder ring assembly to the cover of a ring binder.

Referring to FIG. 3, a binder 10 for holding hole punched sheets of paper (not shown) has side leaves 12 and 14, and a center spine section 16 intermediate the leaves. A binder ring mechanism 18, constructed as is well-known in the art, is attached to a spine material M which is typically a compressed cardboard material. The mechanism includes a plurality of binder rings 20 which are opened and closed by hand or by movement of levers 22 and 24 at respective ends of the ring metal. A metal shield 26 fits over and encloses the levers. It will be noted that except for openings through which binder ring halves extend, the web of material comprising the shield has no openings formed in it. Mechanisms other than that illustrated in FIG. 3 can be used with the fastener of the present invention so long as it as a shield similar to shield 26.

Figure 1:
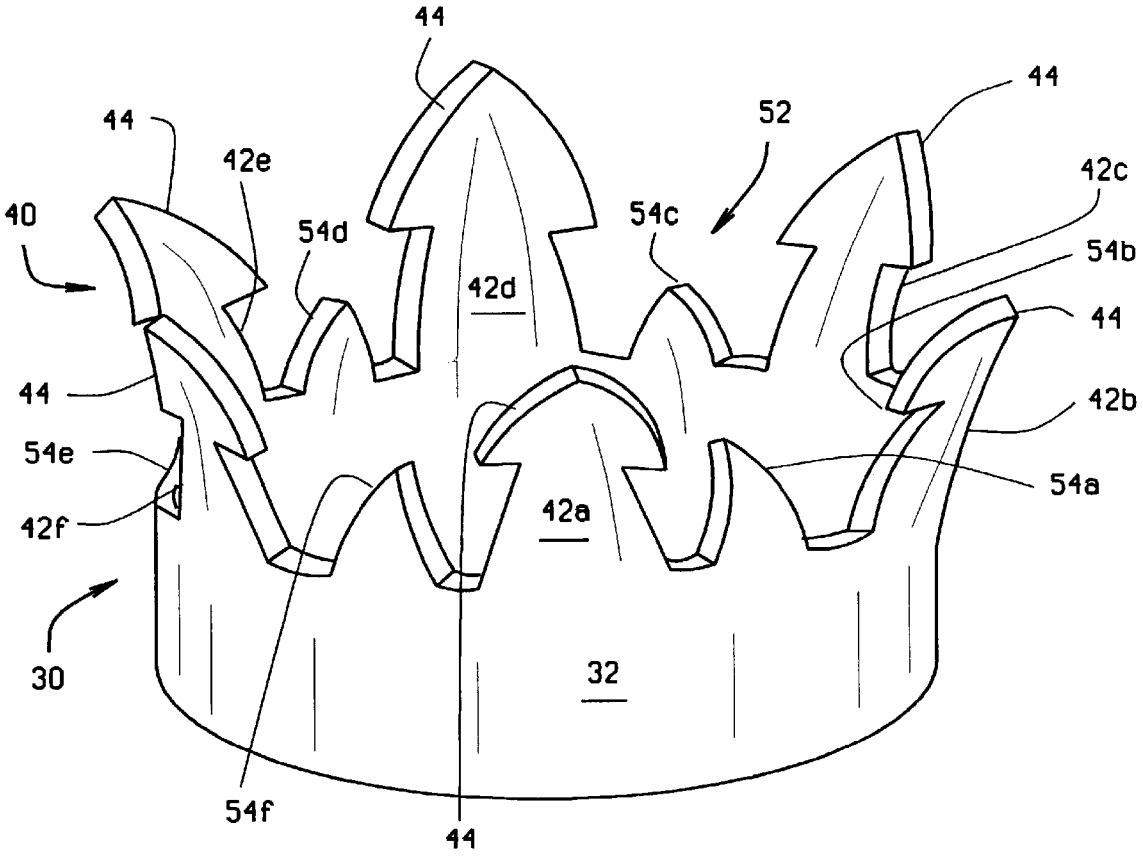
FIG. 1 is a perspective view of a clinch fastener of the present invention commonly referred to as a "crown" fastener.

In the co-assigned U.S. Pat. No. 6,019,538, which is herein incorporated by reference, a clinch fastener is described. In accordance with the present invention, an improved clinch fastener 30, also referred to as a crown fastener because of its crownlike appearance as shown in FIG. 1, is provided for fastening binder ring mechanism 18 to spine 16 of the binder. As shown in FIG. 3, two such fasteners 30 are used, one at each end of the binder. As with the clinch fastener described in the '538 patent, clinch fastener 30 is a concealed fastener which, when installed, is neither visible to someone viewing the outside of the fastener, nor to someone looking at the open binder with shield 26 in view. Also, importantly, the crown fastener of the present invention has a significantly improved holding capability which presents mechanism 18 from being separated from the binder cover, even when mechanism 18 is subjected to significant pulling, side loading and/or twisting.

Figure 4:
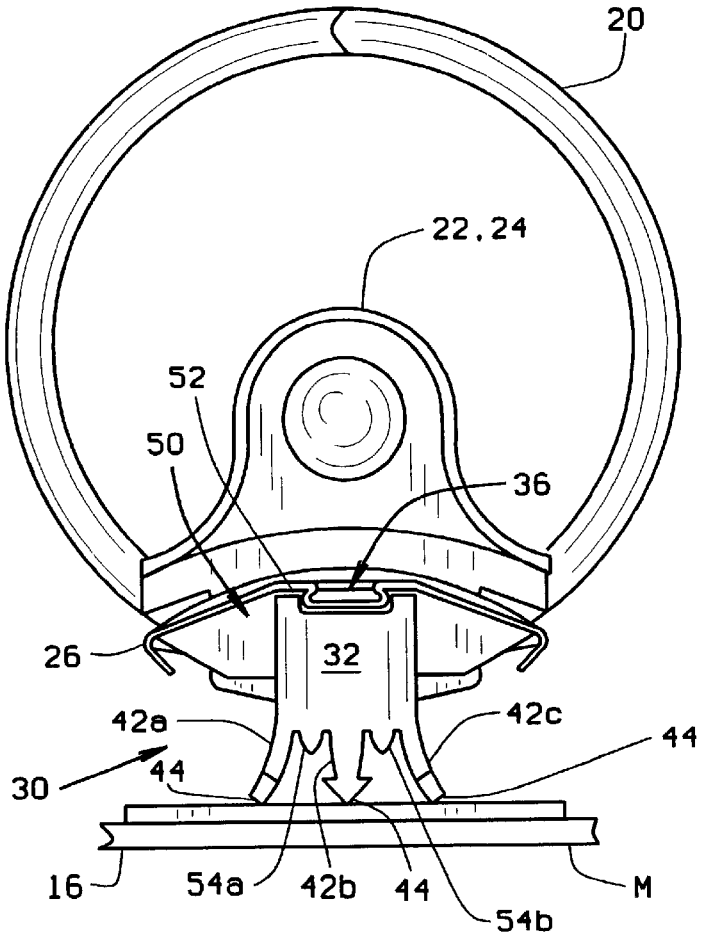
FIG. 4 is an end elevational view of the binder illustrating attachment of the clinch fastener to the binder ring assembly and prior to attachment to the binder cover.

Fastener 30 comprises a body 32 formed of a hollow cylinder closed at one end and open at the other. The closed end of the cylinder forms an end surface 34 which is deformable to attach the fastener to shield 26 of the binder ring mechanism. As shown and described in the '538 patent, this requires abutting surface 34 against the underside of shield 26. A tool is then used to strike the upper surface of the shield driving it into surface 34 of the fastener. This action deforms both the shield surface and surface 34, as indicated at 36 in FIGS. 4 and 5, and interlocks the fastener to the shield. That is, as the tool's impact drives the shield material into surface 34 of fastener 30, surface 34 folds around or envelops the portion of the shield driven into it so to capture the shield and hold it in place. In doing so, however, no portion of the fastener penetrates through the shield. It will also be noted that no separate fasteners such as a rivet are needed. Further, those skilled in the art will recognize that a separate sleeve or eyelet is not required so as to hold the shield 26 in fixed relation with the notebook spine. Still further, those skilled in the art will understand that fastener 30 of the present invention is adapted for use in automated machinery used for the volume production of ring binders. They will further understand that the tool used to strike the shield can be designed and used so that after the closed end of the fastener is attached to the shield the outer surface of the shield will not be unsightly, but rather will have a cosmetically attractive appearance. For example, the striking face of the tool can be designed so that a circular, square, rectangular, or other geometric shape is imparted to the depression formed where the fastener is attached. Again, because no portion of the fastener is driven through the surface of the shield, and because the shield has no opening in it at the location where the fastener is attached, the upper portion of the fastener is not visible after the binder mechanism 18/fasteners 30 sub-assembly is completed.

Figure 2A:
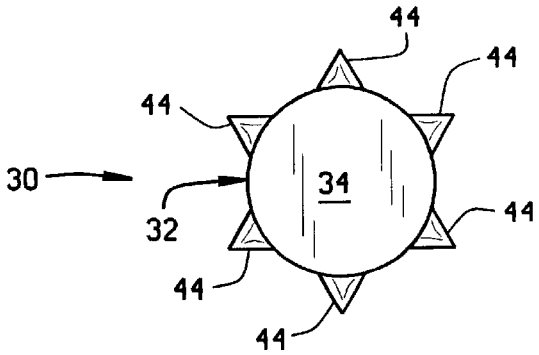
FIG. 2A is a top plan view of the fastener and FIG. 2B is a side elevational view of the fastener.
Figure 2B:
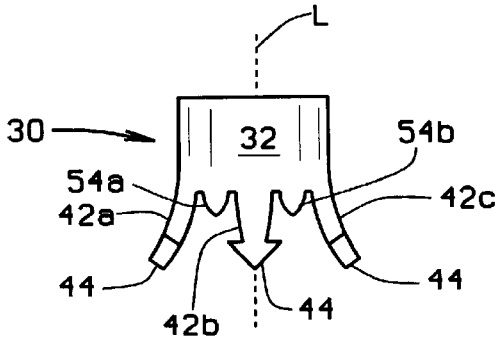

The improved fastener of the present invention next includes a first set 40 of prongs or teeth 42. These prongs, which are formed at the opposite, open end of cylinder 32, are spaced about the periphery of the open end of the fastener. Preferably, the prongs are equidistantly spaced about the periphery of this end of the fastener. Six prongs 42*a*–42*f* are shown in the drawings, these prongs being spaced 60° apart from each other. The number of prongs 42 shown in the drawings is representative only, and fastener 32 may have more or fewer prongs comprising set 40. Each prong 42 extends outwardly from a longitudinal centerline or axis L of fastener 30 (see FIG. 2B). The length of these prongs is preferably, but not necessarily, greater than a thickness T (see FIG. 5) of the backing material M into which the prongs are inserted. Each prong 42 also has a barb or spur 44 formed at its outer end. The barbs serve to increase the holding capability of the fastener as described in the co-assigned Whaley U.S. Pat. No. 5,903,958 by preventing the prongs 42 from being pulled out of the binder spine when the binder is dropped, shaken, or otherwise subjected to a significant force.

Fastener 30 next includes a second set 52 of prongs or teeth 54. These prongs also are formed at the open end of cylinder 32. Each prong 54 of the second set is formed intermediate adjacent prongs 44 forming set 42 and alternate with the first set of prongs. Accordingly, as shown in the drawings, there are six prongs 54*a*–54*e* comprising set 52. Further as shown in the drawings, whereas the prongs 44 forming set 42 extend outwardly from longitudinal axis L of fastener 30, the prongs 54 forming set 52 extend inwardly toward the longitudinal axis. While the angle at which the second set of prongs extend inwardly may vary, depending on the characteristics of spine material M, it has been found that of prongs 54 angle inwardly at an ange of about 5–20°, and preferably, about 7° the inner teeth penetrates the spine material well without flattening as the fastener is driven into the spine material.

Figure 5:
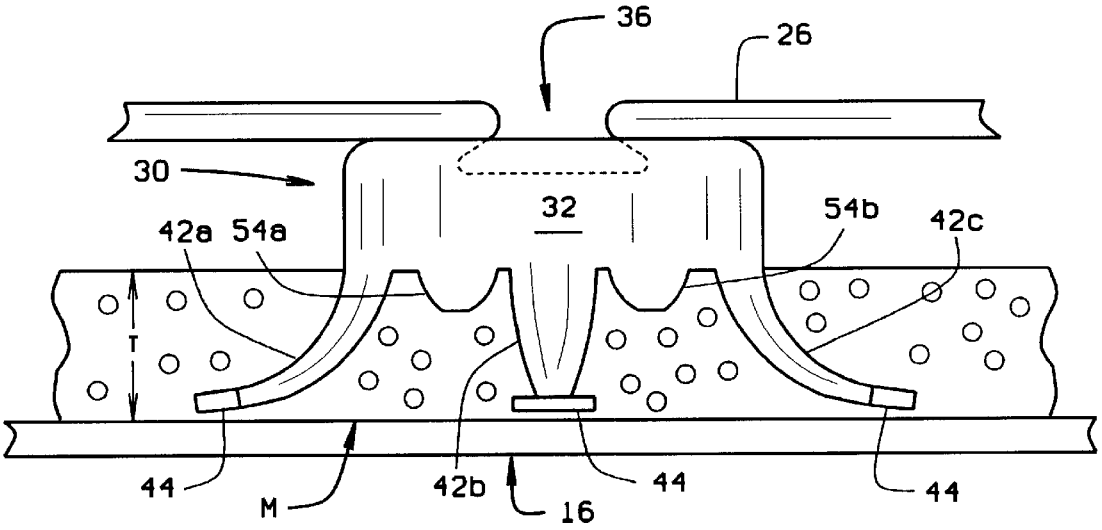
FIG. 5 is an elevational view illustrating attachment of the fastener to a cardboard material forming a spine portion of the binder cover.

In accordance with the invention, the prongs 54 forming set 52 are shorter in length than the prongs 44 forming set 42. In particular, whereas the length of prongs 44 is such that the prongs penetrate substantially through spine backing material M as shown in FIG. 5, the length of the prongs 54 is equal to or less than the thickness of this backing material so that these prongs penetrate into the backing material to a lesser extent than the prongs 42. As indicated in FIG. 5, when fastener 30 is driven into the backing material, the prongs 44 of set 40 splay outwardly while the prongs 54 of set 52 fold or bend inwardly.

The two sets of prongs formed on fastener 30 provide a number of advantages over other fastener constructions. First, the provision of two sets of prongs, with one extending outwardly and the other extending inwardly, provides an additional virgin material(i.e., cardboard whose fibers have not been disturbed or torn by the first set of prongs) grasping capability of the binder spine material. This increases the holding strength of fastener 30. In addition, the set 52 of prongs 54 prevents twisting of binder ring mechanism 18 once the mechanism is attached to the binder using the fasteners 30 so to better prevent the mechanism from being pulled away from the binder cover, particularly when subjected to side loads.

Testing of the crown fasteners of the present invention has shown that the angle at which the prongs are formed with respect to the longitudinal axis of the fastener effects the holding power of the fastener. Specifically, the testing has shown that a shallower or lesser angle (e.g., an angle of about 7°) increases the holding power of the fastener; while an increase in the angle reduces the holding power. Accordingly, the prongs 44 comprising first set 42 are formed at an angle sufficient for the prongs to penetrate into the backing material and splay outwardly so the spurs or barbs 44 on the ends of the prongs have sufficient virgin material to bite against so that the fastener cannot now be readily pulled out of the material. As for the prongs 54 of set 52, by having them curve inwardly, in the opposite direction to the prongs 44, the resulting attachment of binder ring mechanism 18 to the binder cover is more resistant to twisting forces which otherwise also tend to tear the binder ring mechanism away from the cover.

It has been found that with conventional concealed fasteners; i.e., those having plates from which a post extends from one side to attach the fastener to the binder ring mechanism, and prongs extend from the other side and are driven into the binder spine material, that when the fastener is attached to the spine, the spine material is compressed between the prongs and the plate. This fractures and weakens the binder spine material and makes it easier for the prongs to be pulled back out of the material when a force is applied. Tests of these fasteners have shown that forces on the order of 100 pounds are required to pull them out of a spine backing material to which they are attached.

To illustrate the advantages of crown fastener 30 over conventional concealed fasteners, pull tests were performed by an independent testing laboratory to determine the amount of force necessary to extract a fastener from binder spine material. Three separate tests were performed. In each test, a binder mechanism 18 having three rings was used. The load was applied at a 90° angle to the mechanism.

In the first test, fasteners 30 having only six (6) prongs 44 were used. The force required to separate a fastener from a backing material M to which it was attached was

| | |
|---|---|
| Test 1 | 131 pounds |
| Test 2 | 151 pounds |
| Test 3 | 137 pounds |
| Test 4 | 134 pounds |
| Test 5 | 117 pounds |
| Average | 134.0 pounds |

A separate set of tests were performed for fasteners 30 having only six (6) prongs 54. In this second test, the force required to separate a fastener from a backing material M to which it was attached was

| | |
|---|---|
| Test 1 | 61 pounds |
| Test 2 | 75 pounds |
| Test 3 | 58 pounds |
| Test 4 | 77 pounds |
| Test 5 | 70 pounds |
| Average | 68.2 pounds |

The significance of this second test is that it demonstrates the holding capability of a fastener 30 using only the shorter, inwardly turned prongs, while less than the holding capability of the longer teeth, is still significant.

Finally, a third set of tests were performed for fasteners 30 having both sets of prongs, each set comprising six (6) prongs. In this third test, the force required to separate a fastener from the backing material M to which it was attached was

| | |
|---|---|
| Test 1 | 159 pounds |
| Test 2 | 165 pounds |
| Test 3 | 156 pounds |
| Test 4 | 107 pounds |
| Test 5 | 161 pounds |
| Average | 149.6 pounds |

These test results indicate that employing a crown fastener, such as fastener 30, not only has significantly more resistance to tear away forces than conventional fasteners, but also that a fastener 30 having two sets 40 and 50 of prongs provides a holding capability over 10% greater than a fasteners 30 employing only the one set 40 of prongs. This is a significant increase in holding capability.

It has further been found that crown fastener 30, in addition to being usable in cardboard backing materials, is also readily usable in plastic backing materials with the same holding capability.

Figure 6:
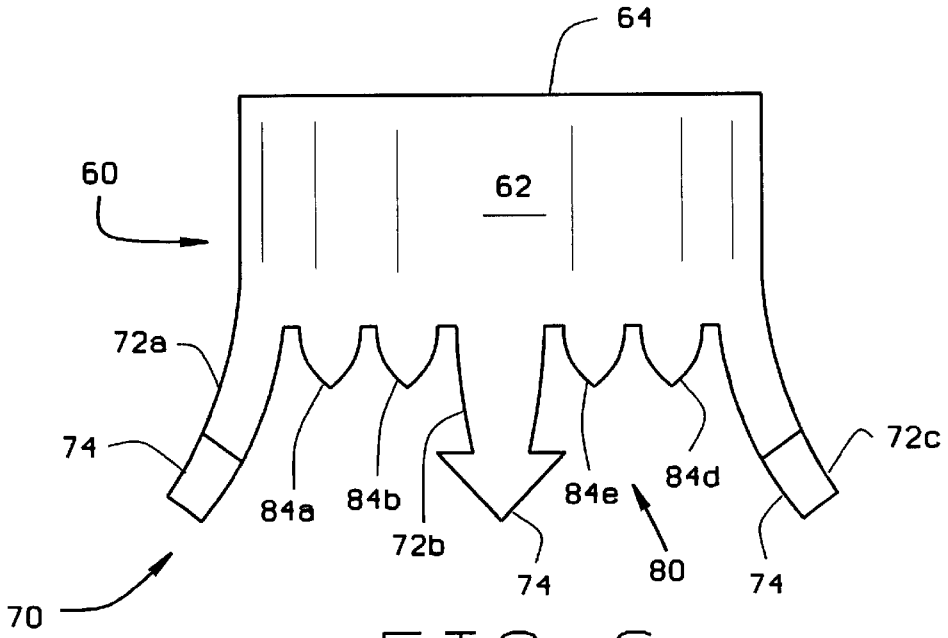
FIG. 6 is an elevational view of another embodiment of the fastener.

Referring to FIG. 6, a second embodiment of the clinch fastener of the present is indicated generally 60. Fastener 60 includes a hollow cylindrical body 62 which is closed at one end. This closed end of the cylinder defines a surface 64 deformable to attach fastener 60 to a binder ring mechanism 18 in the manner previously described. Fastener 60 next includes a first set 70 of prongs 72 which extend from the opposite, open end of cylinder 62. As before, the prongs are spaced about the periphery of this end of the fastener with six prongs 72 (only three of which 72*a*–72*c* are shown in FIG. 6) being spaced 60° apart from each other. Again, the number of prongs is representative only. Each prong 72 extends outwardly from a longitudinal centerline of the fastener. A spur 74 is formed at the outer end of each prong.

Fastener 70 has a second set 80 of prongs 82 which project from the open end of cylinder 62. In this embodiment, at least two prongs 82 are formed intermediate each adjacent pair of prongs 72 of set 70. Accordingly, set 80 includes twelve prongs 84. In FIG. 6, four of these prongs 84*a*–84*d* are shown. These prongs 84 extend inwardly toward the longitudinal axis of fastener 60. As in the previously described embodiment, the prongs 84 are shorter in length than the prongs 74. Attachment of fastener 60 to a spine backing material is again as previously described.

Figure 7:
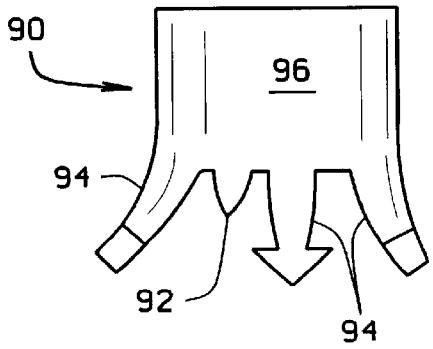
FIG. 7 is an elevational view of a third embodiment.

Finally, referring to FIG. 7, a third embodiment of the clinch fastener is indicated generally 90 and is formed in the same manner as the fasteners 30 and 60 previously described. Now, however, rather than having one or more inwardly extending short prongs 92 formed between adjacent, outwardly extending longer prongs 94, a short prong is formed only between every other adjacent pair of prongs 94. In this embodiment, therefore, while fastener 90 has six prongs 94 formed at its open end, it only has three prongs 92 extending from the open end of fastener body 96.

What has been described is a clinch fastener to attach the binder ring mechanism of a binder to a spine portion thereof. The fastener has a closed end cylindrical body with the closed end being a deformable surface deformed to attach the fastener to the binder ring mechanism. The fastener has two separate sets of prongs formed at the opposite, open end of the body. The first set of prongs extend through the spine backing material and have spurs formed on their ends to grip the material. The second set of prongs are each shorter than prongs of the first set and are formed intermediate the prongs comprising the first set. While the first set of prongs bend outwardly from the fastener body, the second set of prongs bend inwardly. By providing a fastener with two sets of oppositely extending prongs, the binder ring mechanism, when attached to the binder spine, is better able to withstand pulling and twisting forces which tend to separate the two. Not only is the fastener better able to withstand these forces than a conventional fastener having a plate from one side of which a post extends and from the other side of which prongs extend, but also a clinch fastener having only one set of prongs.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A "crown" fastener for securing a binder ring mechanism to a binder cover comprising:

a fastener body having a surface at one end for attaching said fastener to said binder mechanism by abutting said surface against said binder mechanism and then deforming a portion of said binder mechanism and said surface about each other to capture them together;

a first set of prongs projecting from an opposite end of the fastener body for attaching said fastener to the binder cover by positioning said prongs adjacent a portion of the cover and then engaging said prongs with said portion of the cover for said prongs to secure said fastener thereto; and, a second set of prongs also formed at the opposite end of the body and projecting therefrom, said second set of prongs also engaging said portion of the binder cover to increase the holding strength of the fastener and prevent twisting of the mechanism once attached to the binder thereby to lessen the tendency of the mechanism from subsequently being separated from the cover, the prongs forming the first set extending outwardly from a longitudinal axis of the fastener, and the prongs forming the second set extending inwardly toward the longitudinal axis.

2. The crown fastener of claim 1 wherein each prong forming the second set is formed intermediate adjacent prongs forming the first set thereof.

3. The crown fastener of claim 2 wherein the prongs forming the second set are shorter in length than the prongs forming the first set.

4. The crown fastener of claim 3 wherein the length of the prongs forming the second set is equal to or less than a thickness of a backing material into which the prongs are inserted to attach the fastener to the binder.

5. The crown fastener of claim 4 wherein the length of the prongs forming the first set is equal to or greater than the thickness of the backing material into which the prongs are inserted to attach the fastener to the binder.

6. A "crown" fastener for securing a binder ring mechanism to a binder cover comprising:

a fastener body having a surface at one end for attaching said fastener to said binder mechanism by abutting said surface against said binder mechanism and then deforming a portion of said binder mechanism and said surface about each other to capture them together;

a first set of prongs projecting from an opposite end of the fastener body for attaching said fastener to the binder cover by positioning said prongs adjacent a portion of the cover and then engaging said prongs with said portion of the cover for said prongs to secure said fastener thereto; and, a second set of prongs also formed at the opposite end of the body and projecting therefrom, said second set of prongs also engaging said portion of the binder cover to increase the holding strength of the fastener and prevent twisting of the mechanism once attached to the binder thereby to lessen the tendency of the mechanism from subsequently being separated from the cover, said fastener body comprising a cylinder closed at one end, the closed end of the cylinder defining the surface and the prongs forming the respective first and second sets thereof extending from an opposite, open end of the cylinder.

7. The crown fastener of claim 6 wherein each prong comprising the first set of prongs has a spur formed on its outer end.

8. The crown fastener of claim 2 further including at least two prongs of the second set formed intermediate adjacent prongs of the first set.

9. The crown fastener of claim 2 wherein prongs comprising the second set are formed intermediate some, but not all, of the prongs comprising the first set.

10. An improved clinch fastener for securing a binder mechanism to a binder cover, the fastener comprising:

a body having an open end and a closed end, the closed end of the body comprising a surface deformable to attach the fastener to the binder mechanism by abutting the surface against the binder mechanism and striking the binder mechanism with a tool which deforms a portion of the binder mechanism and deforms the surface about said deformed portion of the binder mechanism to capture the deformed portion thereof;

a first set of prongs projecting from an opposite, open end of the body for attaching the fastener to the binder by positioning the prongs adjacent a backing of the binder and then driving the prongs into the backing for the prongs to secure the fastener thereto; and, a second set of prongs also projecting from the opposite end of the body and also driven into the backing for increasing the holding strength of the fastener and preventing twisting of the mechanism once attached to the binder, the prongs forming the first said set extending outwardly from a longitudinal axis of the fastener, and the prongs forming the second set extending inwardly toward the longitudinal axis.

11. The improved clinch fastener of claim 10 wherein each prong forming the second set is formed intermediate prongs forming the first set thereof.

12. The improved clinch fastener of claim 11 wherein the prongs forming the second set are shorter in length than the prongs forming the first set.

13. The improved clinch fastener of claim 10 wherein the length of the prongs forming the second set is equal to or less than the thickness of the backing into which the prongs are driven to attach the fastener to the binder.

14. The improved clinch fastener of claim 13 wherein the length of the prongs forming the first set is equal to or greater than the thickness of the backing into which the prongs are driven to attach the fastener to the binder.

15. The improved clinch fastener of claim 14 wherein each prong comprising the first set of prongs has a spur formed on its outer end.

16. The improved clinch fastener of claim 11 further including at least two prongs of the second set formed intermediate adjacent prongs of the first set.

17. The improved clinch fastener of claim 11 wherein prongs comprising the second set are formed intermediate some, but not all, of the prongs comprising the first set.

18. The crown fastener of claim 6 wherein each prong forming the second set is formed intermediate adjacent prongs forming the first set thereof.

19. The crown fastener of claim 18 wherein the length of the prongs forming the second set is equal to or less than a thickness of a backing material into which the prongs are inserted to attach the fastener to the binder.

20. The crown fastener of claim 18 wherein the length of the prongs forming the first set is equal to or greater than the thickness of the backing material into which the prongs are inserted to attach the fastener to the binder.

* * * * *